US011047183B2

(12) United States Patent
Liu et al.

(10) Patent No.: US 11,047,183 B2
(45) Date of Patent: Jun. 29, 2021

(54) COILED TUBING DRILLING ROBOT, ROBOT SYSTEM AND PROCESS PARAMETER CONTROL METHOD THEREOF

(71) Applicant: CHENGDU UNIVERSITY OF TECHNOLOGY, Chengdu (CN)

(72) Inventors: Qingyou Liu, Chengdu (CN); Haiyan Zhu, Chengdu (CN); Jianguo Zhao, Chengdu (CN); Guorong Wang, Chengdu (CN)

(73) Assignee: CHENGDU UNIVERSITY OF TECHNOLOGY, Chengdu (CN)

( * ) Notice: Subject to any disclaimer, the term of this patent is extended or adjusted under 35 U.S.C. 154(b) by 108 days.

(21) Appl. No.: 16/511,004

(22) Filed: Jul. 15, 2019

(65) Prior Publication Data

US 2020/0181994 A1 Jun. 11, 2020

(30) Foreign Application Priority Data

Dec. 5, 2018 (CN) ..... 201811477460.8
Dec. 5, 2018 (CN) ..... 201811477464.6

(51) Int. Cl.
*E21B 23/00* (2006.01)
*E21B 44/02* (2006.01)
(Continued)

(52) U.S. Cl.
CPC ..... *E21B 23/00* (2013.01); *E21B 21/08* (2013.01); *E21B 34/066* (2013.01); *E21B 44/02* (2013.01); *E21B 23/001* (2020.05)

(58) Field of Classification Search
CPC ..... E21B 23/001; E21B 23/00; E21B 21/08; E21B 21/085; E21B 34/066; E21B 4/18; E21B 44/00; E21B 44/02
See application file for complete search history.

(56) References Cited

U.S. PATENT DOCUMENTS 6,003,606 A 12/1999 Moore et al.
6,640,894 B2 11/2003 Bloom et al.
(Continued)

FOREIGN PATENT DOCUMENTS

CN 102654035 A 9/2012
CN 202788704 U 3/2013
(Continued)

OTHER PUBLICATIONS

Mei Dongqin, et.al., Study on Drill String Vibration Measurement Based on Accelerometer. Oil Field Equipment. Feb. 2012. pp. 1-6. vol. 41. No. 2.

*Primary Examiner* — Caroline N Butcher
(74) *Attorney, Agent, or Firm* — Bayramoglu Law Offices LLC

(57) ABSTRACT

A coiled tubing drilling robot, a robot system and a process parameter control method thereof. The coiled tubing drilling robot is mainly characterized in that a drilling pressure and a drilling speed of a drill string are adjusted by an electric proportional relief valve and an electric proportional flow valve disposed inside the drilling robot; a support mechanism of the drilling robot adopts a single oblique block to prop against a spring piece to clamp a well wall; the coiled tubing drilling robot system consists of a coiled tubing intelligent drilling rig, a wellhead device, a coiled tubing, a drilling robot, a drill string vibration measurement device, a MWD, a power drill and a drill bit.

19 Claims, 2 Drawing Sheets

(51) Int. Cl.
*E21B 21/08* (2006.01)
*E21B 34/06* (2006.01)

(56) References Cited

U.S. PATENT DOCUMENTS

| | | | | |
|---|---|---|---|---|
| 7,273,109 | B2 | 9/2007 | Moore et al. | |
| 8,302,679 | B2 | 11/2012 | Mock | |
| 2003/0116356 | A1* | 6/2003 | Bloom | E21B 4/18 175/97 |
| 2018/0355688 | A1* | 12/2018 | Simon | E21B 23/02 |

FOREIGN PATENT DOCUMENTS

| | | | |
|---|---|---|---|
| CN | 103174391 | A | 6/2013 |
| CN | 103410500 | A | 11/2013 |
| CN | 104533287 | A | 4/2015 |
| CN | 104533288 | A | 4/2015 |
| CN | 107421634 | A | 12/2017 |

* cited by examiner

COILED TUBING DRILLING ROBOT, ROBOT SYSTEM AND PROCESS PARAMETER CONTROL METHOD THEREOF

CROSS REFERENCE TO THE RELATED APPLICATIONS

This application is based upon and claims priority to Chinese Patent Application No. 201811477460.8, filed on Dec. 5, 2018, and Chinese Patent Application No. 201811477464.6, filed on Dec. 5, 2018, the entire contents of which are incorporated herein by reference.

TECHNICAL FIELD

The present invention relates to the field of oil and gas field development, in particular to a coiled tubing drilling robot, a robot system and a process parameter control method thereof.

BACKGROUND

A coiled tubing which is widely used has the advantages of low cost, small size, short operating cycle and the like. In particular, the coiled tubing drilling technology has the following advantages:

(1) the underbalanced pressure drilling operation can be implemented safely, which is beneficial to protect an oil and gas reservoir and increase the drilling speed. The coiled tubing has no joints, which creates favorable conditions for underbalanced pressure drilling.

(2) There is no need to stop pumping for making a connection during the drilling process, which can implement continuous circulation of drilling fluid, reduce the tripping time, shorten the drilling cycle, improve the tripping speed and the operation safety, and avoid the occurrence of blowout and drill-jamming accidents possibly caused by making a connection;

(3) the coiled tubing drilling is especially suitable for small wellbore drilling, old well sidetracking, and old well deepening. In the old well sidetracking or deepening operation, the diameter of the coiled tubing is relatively small for a through-tubing operation, without taking out the existing production equipment from the old well, thereby achieving the purpose of drilling while producing, and significantly saving the drilling cost.

The coiled tubing drilling technology has broad application prospects in unconventional gas reservoirs, tight gas, shale gas and coalbed methane exploration and development in China. For oil and gas fields where conventional oil and gas wells are difficult to extract efficiently, in order to increase the output of oil and gas fields, it is also a good choice to develop the coiled tubing horizontal well technology.

When a coiled tubing drilling operation is performed in a horizontal well, a drilling pipe string will be subjected to frictional resistance from the well wall, and the frictional resistance will increase as the length of the horizontal well and the hole drift angle increase. Since the coiled tubing is a flexible pipe, a pressure cannot be applied from the wellhead. Therefore, the drilling pipe string is generally difficult to enter and the drilling pressure of the drill bit is difficult to provide. At present, two methods are commonly used at home and abroad to solve this problems: 1, a method of reducing the frictional resistance, such as mechanical structure drag reduction and lubricant drag reduction is adopted to reduce the friction and solve this problem to a certain extent; 2, a downhole robot is adopted to pull the pipe string, and this method will provide an axial tension for the pipe string, which can fundamentally solve this problem.

Downhole traction robots are mainly divided into two types: a wheeled traction robot and a telescopic traction robot according to their different driving modes. The wheeled traction robot has a high traction speed but a small traction force and cannot be used for coiled tubing drilling operations. The telescopic traction robot usually uses a motor and a hydraulic pump to provide a hydraulic pressure. An electromagnetic reversing valve is used to alternately feed liquid to a supporting cylinder and a telescopic cylinder. The robot creeps forward and crawls. Compared with the wheeled downhole robot, the telescopic downhole robot has a relatively large traction.

Compared with the telescopic traction robot, the telescopic drilling robot has a mud flow path, which can be used for drilling operations in conjunction with related downhole tools. There are two representative products at home and abroad:

Chongqing Institute of Science and Technology published a downhole traction robot (Patent No.: 201220404293.6, An Electronically Controlled Hydraulic Driven Coiled Tubing Downhole Tractor). This patent discloses a coiled tubing traction robot that includes a spring-piece type supporting mechanism. This traction robot uses a servo reversing valve to control drilling fluid to support three sets of three-slope supporting blocks, thereby supporting a spring piece to clamp the well wall. The servo reversing valve needs to be driven by a motor, and is bulky and difficult to arrange in the traction robot, making the traction robot difficult to miniaturize. In addition, the three-slope supporting block mechanism has a complicated shape, so that the corresponding spring piece structure is redundant, and this supporting mode cannot withstand the reactive torque from the drill bit when used for drilling. A control system (patent number: CN103174391A, A Control System for Electronically Controlled Hydraulically Driven Coiled Tubing Downhole Tractor) of the downhole traction robot is based on a double-support single-telescopic downhole tractor with a low traction. A five-position three-way reversing valve and a five-position four-way reversing valve controlled by a servo stepping motor can control the traction speed by changing an opening area of a valve core, but is inconvenient to control, complicated in structure and difficult to arrange, resulting in the size of the traction robot not being miniaturized.

The US Western Drilling Company WWT proposed a horizontal well drilling robot system based on a hydraulic telescopic drilling robot, and applied for the corresponding invention patents (U.S. Pat. Nos. 6,003,606A, 7,273,109B1) for the drilling robot. A hydraulic control system for the drilling robot is based on a hydraulically controlled three-position nine-way reversing valve, such that the structure is complicated, many valve bodies are difficult to arrange and miniaturize, and the drilling speed and drilling pressure cannot be flexibly controlled according to requirements. The corresponding drilling robot and the drilling system based on the drilling robot are introduced at the same time. The drilling robot system is mainly subjected to ground control, and thus cannot adjust the drilling speed and the drilling pressure in real time according to the downhole working conditions, and cannot implement intelligent drilling.

The drilling robot also has two supporting mechanisms, one of which is a roller type supporting mechanism disclosed in the U.S. Pat. No. 6,640,894. This supporting mechanism is provided with two slopes on a spring piece.

Two rollers are arranged on a supporting block, and a hydraulic pressure drives the supporting block to move radially, such that the rollers drive the spring piece to support and clamp the well wall. The rollers of the supporting mechanism are in point contact with the slope on the spring piece with a contact area, so that the supporting force of the supporting mechanism is small. On the basis of the patent U.S. Pat. No. 6,640,894, the U.S. Pat. No. 8,302,679 adopts a connecting rod mechanism and a roller mechanism to support the spring piece. The structure of the connecting rod mechanism is complicated, such that the support is unstable and easy to fail. Neither of these supporting mechanisms can withstand the reactive torque from the drill bit and cannot be used for drilling.

In the process of coiled tubing drilling, the factor that is most difficult to control and has greatest effect on drilling operation is the vibration of the drill string. The reasons for the vibration of the drill string are very complicated and can be roughly divided into the following types:

(1) the structural characteristics and damage of the drill bit itself may cause vibration when it breaks the rock.

(2) The lithology and anisotropy of the formation as well as bit bouncing and bit jamming caused by the unevenness of the downhole generate vibration.

(3) Pumping fluctuations, and circulating flow of drilling fluid inside and outside the drill string usually also intensify and induce the vibration of the drill string.

Drill string vibration can cause serious damage to the drill string, especially the drill bit, but at the same time we can judge the downhole working conditions through the vibration of the drill string. Some people at home and abroad have studied this method and published a series of patent articles (patents: CN103410500A, CN201710308225.7, Article: Mei Dongqin, et.al., Research on Vibration Measurement Method of Drill String Based on Acceleration Sensor).

The Chinese patents CN102654035.A, CN201410665275.7 and CN201410665671.X have published several methods using a system for towing a coiled tubing to drill by using a drilling robot-based bottom hole assembly, and imagined a perfect drilling robot that can perform drilling operations, but there is no mention of how to control the actual problems in drilling speed, drilling pressure and the like when the drilling assembly drills.

The main reasons for the failure of the coiled tubing drilling technology in long horizontal sections are as follows:

(1) coiled tubing drilling operations are suitable for small boreholes and small wellbore operations, however, due to the limitation of the mud flow path, coupled with the complicated structure of the existing drilling robot control system, the arrangement of a large valve body is difficult, and the size of the drilling robot is difficult to be miniaturized;

(2) when drilling with a coiled tubing drilling robot, it is necessary to control the drilling speed and the drilling pressure of the drill string according to factors such as a formation structure and a drilling depth, and the control system for the existing drilling robot is difficult to realize;

(3) the spring piece supporting mechanism of the existing drilling robot has a series of defects, such as complicated structure, unsuitablity for a small wellbore, unstable support and small supporting force, and cannot withstand the reverse torque from the drill bit during drilling;

(4) several methods using a system for towing a coiled tubing to drill by using a drilling robot-based bottom hole assembly are disclosed at home and abroad, and it is imagined a perfect drilling robot that can perform drilling operations, but there is no mention of how to control the actual problems in drilling speed, drilling pressure and the like when the drilling assembly drills.

SUMMARY

In order to promote the successful application of a coiled tubing drilling technology for long horizontal sections and to solve the defects of control systems and supporting mechanisms for existing drilling robot technologies, the present invention provides a coiled tubing drilling robot, a robot system and a process parameter control method thereof. A drilling robot of a coiled tubing drilling robot can adjust the drilling speed and the drilling pressure of a drill string in the drilling process in real time in combination with a supporting downhole tool, and solve the vibration problem of the drill string during the coiled tubing drilling operation, such that the drilling system can self-adapt to the downhole working conditions, and form a downhole closed-loop drilling system, thereby implementing intelligent continuous drilling. The drilling robot also has a novel supporting mechanism, which is suitable for small wellbores, has the advantages of large supporting force, simple structure, stable support, and the like and can withstand the reactive torque from the drill bit.

To fulfill said objective, the present invention is implemented by means of the following solution:

a coiled tubing drilling robot comprises a first main body, a control short section and a second main body, wherein the first main body is located upstream of the second main body, and the control short section is located between the first main body and the second main body, and a drilling fluid flow path traverses through the first main body, the control short section and the second main body; a first supporting cylinder, a first supporting arm and a first telescopic cylinder are arranged on the first main body, wherein the first supporting cylinder is located upstream of the first telescopic cylinder, and the first supporting arm is located between the first supporting cylinder and the first telescopic cylinder; a second telescopic cylinder, a second supporting arm and a second supporting cylinder are arranged on the second main body, wherein the second supporting cylinder is located upstream of the second telescopic cylinder, and the second supporting arm is located between the second supporting cylinder and the second telescopic cylinder; a piston rod on which a single oblique block is fixedly arranged is respectively arranged in each of the first supporting cylinder and the second supporting cylinder; each single oblique block is provided with a groove. The first supporting cylinder, the second supporting cylinder, the first telescopic cylinder and the second telescopic cylinder are double acting cylinders. By introducing drilling fluid to both ends of each supporting cylinder, the piston rod is pushed and pulled to support the supporting arm to clamp the well wall or release the well wall. By introducing the drilling fluid to both ends of each telescopic cylinder, the drilling robot is towed to move forward or backward.

In a further technical solution, a spring piece is arranged in the supporting arm, an oblique block is fixedly arranged at the lower end of the spring piece, and the oblique block is matched with the groove. Therefore, the supporting arm can withstand a reactive torque from the drill bit during the drilling process performed by the drilling robot.

In a further technical solution, an arc-shaped surface A is formed on the oblique block, and an arc-shaped surface B is formed on the single oblique block. The arc-shaped surfaces may reduce the pressure drop created by the drilling fluid flowing through the supporting arm and reduce the probability of bit balling at the supporting arm.

In a further technical solution, the control short section is respectively provided with an upstream liquid inlet and a downstream liquid inlet; the upstream liquid inlet is connected to the first supporting cylinder and the first telescopic cylinder via pipelines, and used for introducing the drilling fluid into the first supporting cylinder and the second telescopic cylinder; the downstream liquid inlet is connected to the second telescopic cylinder and the second supporting cylinder via pipelines and used for introducing the drilling fluid into the second supporting cylinder and the second telescopic cylinder.

In a further technical solution, a pressure sensor A, an upstream filter, a two-position four-way electromagnetic reversing valve A, an electric proportional relief valve B and a pressure difference sensor A are arranged in sequence on the pipeline between the upstream liquid inlet and the first supporting cylinder; the two-position four-way electromagnetic reversing valve A and the electric proportional relief valve B are connected to a downhole annulus via pipelines. A downstream filter, a two-position four-way electromagnetic reversing valve B, an electric proportional relief valve C and a pressure difference sensor C are arranged in sequence on the pipeline between the downstream liquid inlet and the second supporting cylinder; the electric proportional relief valve C and the two-position four-way electromagnetic reversing valve B are connected to the downhole annulus via pipelines. The electric proportional relief valve may control the pressure at the inlet of the respective supporting cylinder to control the supporting force of the support mechanism. The coiled tubing drilling robot 40 does not get stuck because the supporting arm is stuck in the well wall. The electric proportional relief valve and the pressure difference sensor act in real time to control the supporting force of the supporting arm. The well wall will not be damaged due to an excessive support force or a too small supporting force.

In a further technical solution, the first telescopic cylinder adopts a differential connection pipeline, and a pressure sensor B, a flow sensor A, an electric proportional relief valve A, an electric proportional throttle valve A and a three-position four-way electromagnetic reversing valve A are arranged on a connection pipeline between an upstream chamber and a downstream chamber of a piston of the differential connection pipeline. The second telescopic cylinder adopts a differential connection pipeline, and a pressure sensor D, a flow sensor B, an electric proportional relief valve D, an electric proportional throttle valve B and a three-position four-way electromagnetic reversing valve B are arranged on a connection pipeline between an upstream chamber and a downstream chamber of a piston of the differential connection pipeline. This arrangement can control the drilling speed and the drilling pressure of the drilling robot by simultaneously adjusting the electric proportional flow valve and the electric proportional relief valve.

A coiled tubing drilling robot system comprises a coiled tubing intelligent drilling rig, a wellhead device, a coiled tubing, a coiled tubing drilling robot, a drill string vibration measurement device, a MWD, a power drill, and a drill bit; the coiled tubing intelligent drilling rig feeds the coiled tubing into the bottom of the well through the wellhead device; the front end of the coiled tubing is connected to the drilling robot, the drill string vibration measurement device, the MWD, the power drill and the drill bit in sequence. The coiled tubing intelligent drilling rig is equipped with a mud pump, a mud pulse signal generator and a ground control system, wherein the drilling robot uses mud as a power source; the ground control system can control the robot to be turned on or turned off through the mud pulse signal generator; the MWD is used to transmit signals between the bottom of the well and the ground control system. An acceleration sensor is arranged inside the drill string vibration measurement device to measure the longitudinal vibration, the lateral vibration and the torsional vibration of the drill string. By analyzing these parameters, the specific working conditions of the bottom hole can be obtained.

A process parameter control method for a coiled tubing drilling robot system comprises the following steps:

S1, the coiled tubing intelligent drilling rig generates mud pressure pulse waves to turn on the coiled tubing drilling robot;

S2, the coiled tubing drilling robot drives the drill string to drill forward;

S3, when the drill string drills forward, the drill string vibration measurement device measures the vibration condition of the drill string in real time;

S4, the coiled tubing drilling robot drives the drill string to drill forward at an optimal drilling speed and drilling pressure according to the vibration condition of the drill string measured by the drill string vibration measurement device; and S5, the coiled tubing drilling robot stops drilling.

In a further solution, the step S2 specifically comprises the following steps:

S201: the coiled tubing drilling robot determines a series of factors affecting drilling, such as a depth of a formation where the drill string is located, rock performances and bit wear; and S202, the drilling robot calculates an appropriate drilling speed and drilling pressure according to these factors, and drives the drill string to drill forward.

In a further solution, the step S4 specifically comprises the following steps:

S401, the coiled tubing drilling robot calculates and analyze results, such as rock performances and bit wear degree according to the vibration conditions of the drill string measured by the drill string vibration measurement device; and S402: the coiled tubing drilling robot calculates an appropriate drilling speed and drilling pressure according to these results, and drives the drill string to drill forward; the drill string vibration measurement device then feeds back the vibration conditions of the drill string in real time and self-adapt to actual working conditions.

In a further technical solution, in the step S5, the drilling robot can be controlled to be turned on and turned off by the ground control system; the coiled tubing drilling robot determines downhole working conditions according to the vibration conditions of the drill string measured by the drill string vibration measurement device; when accidental conditions, such as severe bit damage and formation leakage occurs in the downhole, the drilling system fails to be self-adapted, the coiled tubing drilling robot stops drilling.

Figure 1:
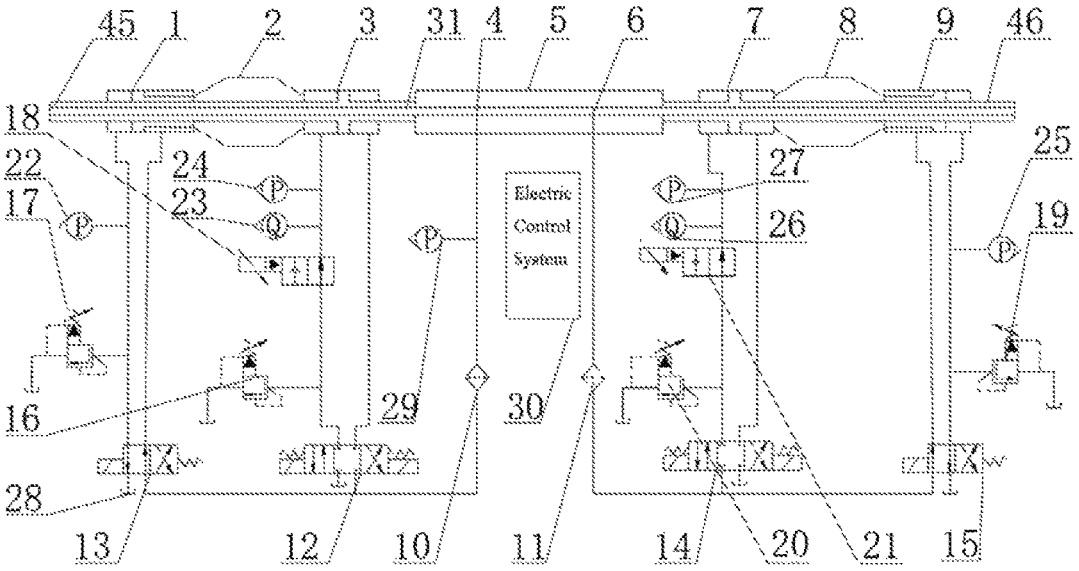
FIG. 1 is a schematic diagram of an electro-hydraulic control system for a coiled tubing drilling robot.

In drawings, reference symbols represent the following components: 1, first supporting cylinder; 2, first supporting arm; 3, first telescopic cylinder; 4, upstream liquid inlet; 5, control short section; 6, downstream liquid inlet; 7, second telescopic cylinder; 8, second supporting arm; 9, second supporting cylinder; 10, upstream filter; 11, downstream filter; 12, three-position four-way electromagnetic reversing valve A; 13, two-position four-way electromagnetic reversing valve A; 14, three-position four-way electromagnetic reversing valve B; 15, two-position four-way electromagnetic reversing valve B; 16, electric proportional relief valve A; 17, electric proportional relief valve B; 18, electric proportional throttle valve A; 19, electric proportional relief valve C; 20, electric proportional relief valve D; 21, electric proportional throttle valve B; 22, pressure difference sensor A; 23, flow sensor A; 24, pressure difference sensor B; 25, pressure difference sensor C; 26, flow sensor B; 27, pressure difference sensor D; 28, downhole annulus; 29, pressure sensor A; 30, electronic control system; 31, drilling fluid flow path; 32, supporting cylinder; 33, single oblique block; 34, spring piece; 35, oblique block; 36, groove; 37, coiled tubing intelligent drilling rig; 38, wellhead device; 39, coiled tubing; 40, drilling robot; 41, drill string vibration measurement device; 42, MWD; 43, power drill; 44, drill bit; 45, first main body; 46, second main body; 47, arc-shaped surface A; 48, arc-shaped surface B.

DETAILED DESCRIPTION OF THE EMBODIMENTS

For a better understanding of the technical features, objects, and advantages of the present invention, the specific embodiments of the present invention will be described with reference to the accompanying drawings.

As shown in FIGS. 1-8, a coiled tubing drilling robot 40 comprises a first main body 45, a control short section 5 and a second main body 46, wherein the first main body 45, the control short section 5 and the second main body 46 are connected in sequence from upstream to downstream; a drilling fluid flow path transverses through the first main body 45, the control short section 5 and the second main body 46; a first supporting cylinder 1, a first supporting arm 2 and a first telescopic cylinder 3 are arranged on the first main body 45 in sequence from upstream to downstream; a second telescopic cylinder 7, a second supporting arm 8 and a second supporting cylinder 9 are arranged on the second main body 46 in sequence from upstream to downstream; a piston rod on which a single oblique block 35 is fixedly arranged is respectively arranged in the first supporting cylinder and the second supporting cylinder; each single oblique block is provided with a groove 36. The first supporting cylinder 1, the second supporting cylinder 9, the first telescopic cylinder 3 and the second telescopic cylinder 7 are double acting cylinders. By introducing drilling fluid to both ends of each supporting cylinder, the piston rod is pushed and pulled to support the respective supporting arm to clamp the well wall or release the well wall. By introducing the drilling fluid to both ends of each supporting cylinder, the drilling robot is towed to move forward or backward.

As shown in FIGS. 5-8, a spring piece 34 is arranged in the supporting arm, an oblique block 35 is fixedly arranged at the lower end of the spring piece, and the oblique block is matched with the groove. Therefore, the supporting arm can withstand a reactive torque from the drill bit during the drilling process performed by the drilling robot. This supporting method has the advantages of suitability for small wellbores, a large supporting force, a simple structure, a stable support and the like.

As shown in FIGS. 5-8, an arc-shaped surface A 47 is formed on the oblique block, and an arc-shaped surface B 48 is formed on the single oblique block. The arc-shaped surfaces may reduce the pressure drop created by the drilling fluid flowing through the supporting arm and reduce the probability of bit balling at the supporting arm.

Figure 2:
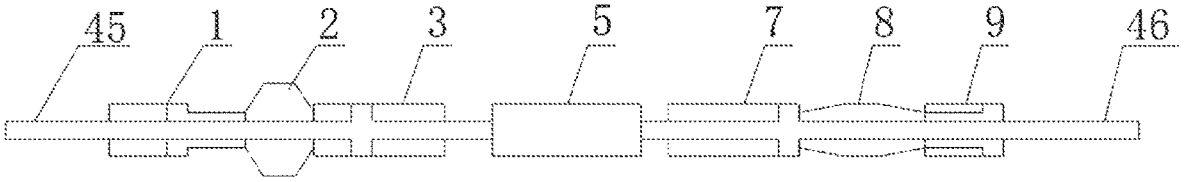
FIG. 2 is a schematic diagram in the course of drilling when a first telescopic cylinder acts.
Figure 3:
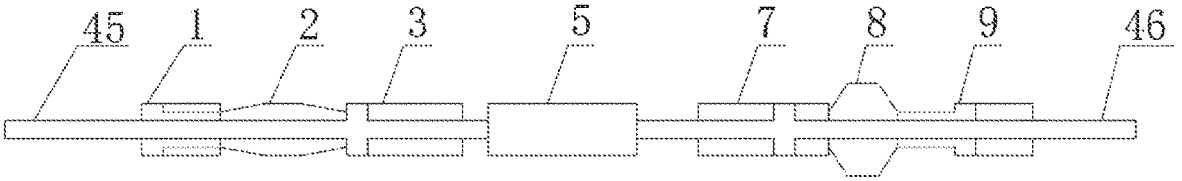
FIG. 3 is a schematic diagram in the course of drilling when a second telescopic cylinder acts.
Figure 4:
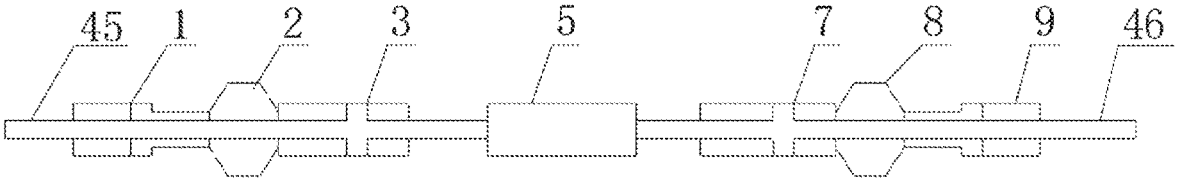
FIG. 4 is a schematic diagram in the course of drilling when the first telescopic cylinder and the second telescopic cylinder act together.
Figure 5:
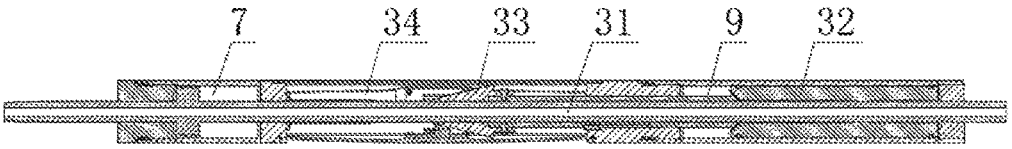
FIG. 5 is a schematic structural diagram of a working short section of the coiled tubing drilling robot.
Figure 6:
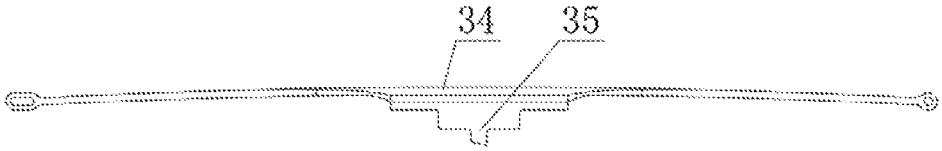
FIG. 6 is a main view of a spring piece.
Figure 7:
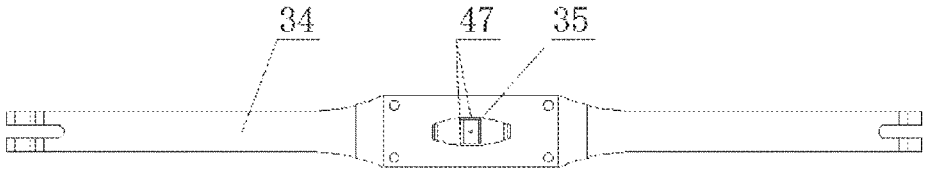
FIG. 7 is a bottom view of the spring piece.
Figure 8:
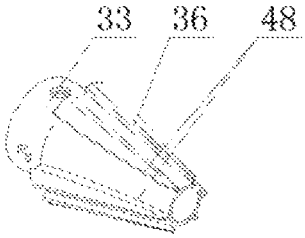
FIG. 8 is a schematic structural diagram of a single oblique block.

As shown in FIGS. 1-4, the control short section is respectively provided with an upstream liquid inlet 4 and a downstream liquid inlet 6; the upstream liquid inlet is connected to the first supporting cylinder 1 and the first telescopic cylinder 3 via pipelines, and used for introducing the drilling fluid into the first supporting cylinder 1 and the second telescopic cylinder 3; the downstream liquid inlet is connected to the second telescopic cylinder 7 and the second supporting cylinder 9 via pipelines and used for introducing the drilling fluid into the second supporting cylinder 9 and the second telescopic cylinder 7. When the drilling fluid enters the upstream end of the first telescopic cylinder 3 from the liquid inlet 4, the drilling robot 40 drills forward in a manner as shown in FIG. 2. When the drilling fluid enters the upstream end of the second telescopic cylinder 7 from the liquid inlet 5, the coiled tubing intelligent coiled tubing drilling robot 40 drills forward in a manner shown in FIG. 3. The first telescopic cylinder 3 and the second telescopic cylinder 7 can also cooperate to realize the stepless adjustment of a drilling pressure of the coiled tubing intelligent coiled tubing drilling robot 40. The robot drills forward in a drilling mode shown in FIG. 4, and in this case, the robot's traction is twice that of single-cylinder traction.

As shown in FIG. 1, a pressure sensor A29, an upstream filter 10, a two-position four-way electromagnetic reversing valve A 13, an electric proportional relief valve B17 and a pressure difference sensor A 22 are arranged in sequence on the pipeline between the upstream liquid inlet 3 and the first supporting cylinder 1; the two-position four-way electromagnetic reversing valve A15 and the electric proportional relief valve B19 are connected to a downhole annulus 28 via pipelines. A downstream filter 11, a two-position four-way electromagnetic reversing valve B15, an electric proportional relief valve C19 and a pressure difference sensor C25 are arranged in sequence on the pipeline between the downstream liquid inlet 6 and the second supporting cylinder 9; the electric proportional relief valve C19 and the two-position four-way electromagnetic reversing valve B15 are connected to the downhole annulus via pipelines. The electric proportional relief valve may control the pressure at the inlet of the respective supporting cylinder to control the supporting force of the support mechanism.

As shown in FIG. 1, the first telescopic cylinder 3 adopts a differential connection pipeline, and a pressure difference sensor B24, a flow sensor A24, an electric proportional relief valve A, an electric proportional throttle valve A16 and a three-position four-way electromagnetic reversing valve A are arranged on a connection pipeline between an upstream chamber and a downstream chamber of a piston of the differential connection pipeline. The second telescopic cylinder 7 adopts a differential connection pipeline, and a pressure difference sensor D27, a flow sensor B26, an electric proportional relief valve D20, an electric proportional throttle valve B21 and a three-position four-way electromagnetic reversing valve B15 are arranged on a connection pipeline between an upstream chamber and a downstream chamber of a piston of the differential connection pipeline. This arrangement can control the drilling speed and the drilling pressure of the drilling robot by simultaneously adjusting the electric proportional flow valve and the electric proportional relief valve.

Figure 9:
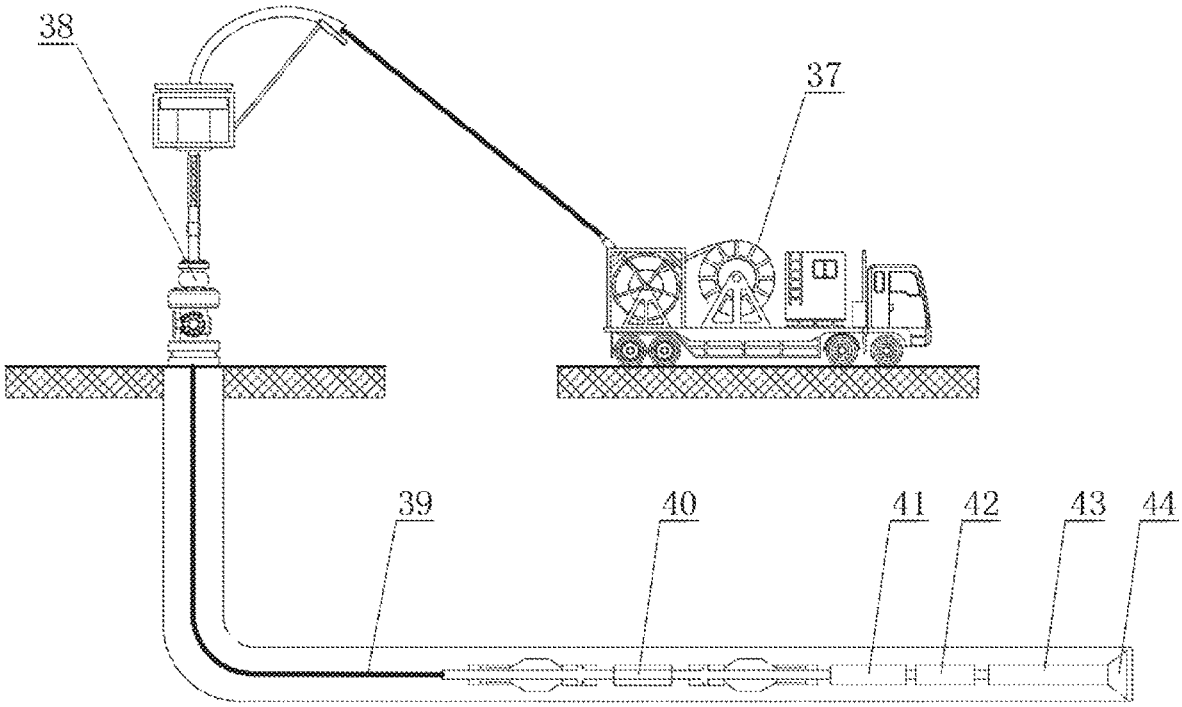
FIG. 9 is a schematic diagram of the coiled tubing drilling robot system.

As shown in FIG. 9, a system for controlling a drilling speed and a drilling pressure of the coiled tubing comprises a coiled tubing intelligent drilling rig 37, a wellhead device 38, a coiled tubing 39, an intelligent coiled tubing drilling robot 40, a drill string vibration measurement device 41, a MWD 42, a power drill 43, and a drill bit 44; the coiled tubing intelligent drilling rig 37 feeds the coiled tubing 39 into the bottom of the well through the wellhead device 38; the front end of the coiled tubing is connected to the intelligent coiled tubing drilling robot 40, the drill string vibration measurement device 41, the MWD 42, the power drill 43 and the drill bit 44 in sequence. The coiled tubing intelligent drilling rig 37 is equipped with a mud pump, a mud pulse signal generator and a ground control system, wherein the drilling robot uses mud as a power source; the ground control system can control the robot to be turned on or turned off through the mud pulse signal generator; the MWD 42 is used to transmit signals between the bottom of the well and the ground control system. An acceleration sensor is arranged inside the drill string vibration measurement device 41 to measure the longitudinal vibration, the lateral vibration and the torsional vibration of the drill string. By analyzing these parameters, the specific working conditions of the bottom hole can be obtained.

A process parameter control method for an intelligent coiled tubing drilling robot comprises the following steps:

S1, the coiled tubing intelligent drilling rig 37 generates mud pressure pulse waves to turn on the intelligent coiled tubing drilling robot 40;

S2, the intelligent coiled tubing drilling robot 40 drives the drill string to drill forward;

S3, when the drill string drills forward, the drill string vibration measurement device 41 measures the vibration condition of the drill string in real time;

S4, the intelligent coiled tubing drilling robot 40 drives the drill string to drill forward at an optimal drilling speed and drilling pressure according to the vibration conditions of the drill string measured by the drill string vibration measurement device 41; and S5, the coiled tubing drilling robot 40 stops drilling.

The step S2 specifically comprises the following steps:

S201: the intelligent coiled tubing drilling robot 40 determines a series of factors affecting drilling, such as a depth of a formation where the drill string is located, rock performances and bit wear; and S202, the coiled tubing drilling robot 40 calculates an appropriate drilling speed and drilling pressure according to these factors, and drives the drill string to drill forward.

The step S4 specifically comprises the following steps:

S401, the coiled tubing drilling robot 40 calculates and analyze results, such as rock performances and bit wear degree according to the vibration condition of the drill string measured by the drill string vibration measurement device 41; and S402: the intelligent coiled tubing drilling robot 40 calculates an appropriate drilling speed and drilling pressure according to these results, and drives the drill string to drill forward; the drill string vibration measurement device 41 then feeds back the vibration conditions of the drill string in real time and self-adapt to actual working conditions.

In the step S5, the intelligent coiled tubing drilling robot 40 can be controlled to be turned on and turned off by the ground control system; the downhole working conditions may also be obtained according to the vibration conditions of the drill string measured by the drill string vibration measurement device; when accidental conditions, such as severe bit damage of the drill bit 43 and formation leakage occurs in the bottom of the well, the drilling system falls to be self-adapted, the coiled tubing drilling robot 40 stops drilling.

The above content is only specific exemplary embodiments of the present invention and is not intended to limit the scope of the present invention. Equivalent changes and modifications made by those skilled in the art without departing from the concept and principle of the present invention are intended to be within the protection scope of the present invention.

What is claimed is:

1. A coiled tubing drilling robot, comprising:

a first main body, a control short section and a second main body wherein the first main body is located upstream of the second main body, and the control short section is located between the first main body and the second main body, and a drilling fluid flow path traverses through the first main body, the control short section and the second main body;

a first supporting cylinder, a first supporting arm and a first telescopic cylinder are arranged on the first main body, wherein the first supporting cylinder is located upstream of the first telescopic cylinder, and the first supporting arm is located between the first supporting cylinder and the first telescopic cylinder;

a second telescopic cylinder, a second supporting arm and a second supporting cylinder are arranged on the second main body, wherein the second supporting cylinder is located upstream of the second telescopic cylinder, and the second supporting arm is located between the second supporting cylinder and the second telescopic cylinder;

a piston rod arranged in each of the first supporting cylinder and the second supporting cylinder, wherein a single oblique block is fixedly arranged on each of the piston rods; each single oblique block is provided with a groove, and a spring piece is arranged in each of the first and the second supporting arms, an oblique block is fixedly arranged at a bottom of each of the spring pieces, and a size of the oblique block is matched with a size of the groove.

2. The coiled tubing drilling robot according to claim 1, wherein an arc-shaped surface A is formed on the oblique block, and an arc-shaped surface B is formed on each of the single oblique blocks.

3. The coiled tubing drilling robot according to claim 2, wherein a first pressure sensor, an upstream filter, a first two-position four-way electromagnetic reversing valve, a second pressure sensor and a first electric proportional relief valve are arranged on the pipeline between an upstream liquid inlet and the first supporting cylinder; the first two-position four-way electromagnetic reversing valve and the first electric proportional relief valve are connected to a downhole annulus via pipelines.

4. The coiled tubing drilling robot according to claim 2, wherein a pressure sensor, a downstream filter, a two-position four-way electromagnetic reversing valve and an electric proportional relief valve are arranged on the pipeline between downstream a liquid inlet and the second supporting cylinder; the electric proportional relief valve and the two-position four-way electromagnetic reversing valve are connected to a downhole annulus via pipelines.

5. The coiled tubing drilling robot according to claim 1, wherein the control short section includes an upstream liquid inlet and a downstream liquid inlet; the upstream liquid inlet is connected to the first supporting cylinder and the first telescopic cylinder via pipelines, and the downstream liquid inlet is connected to the second telescopic cylinder and the second supporting cylinder via pipelines.

6. The coiled tubing drilling robot according to claim 1, wherein the first telescopic cylinder has a differential connection pipeline, and a pressure sensor, a flow sensor, an electric proportional relief valve, an electric proportional throttle valve and a three-position four-way electromagnetic reversing valve are arranged on a connection pipeline between an upstream chamber and a downstream chamber of a piston of the first telescopic cylinder.

7. The coiled tubing drilling robot according to claim 1, wherein the second telescopic cylinder has a differential connection pipeline, and a pressure sensor, a flow sensor, an electric proportional relief valve, an electric proportional throttle valve and a three-position four-way electromagnetic reversing valve arranged on a connection pipeline between an upstream chamber and a downstream chamber of a piston of the second telescopic cylinder.

8. A coiled tubing drilling robot system consisting of the coiled tubing drilling robot according to claim 1, comprising a coiled tubing and the coiled tubing drilling robot; a coiled tubing intelligent drilling rig is fixedly arranged at one end of the coiled tubing, and the other end of the coiled tubing is connected to an above ground surface end of the coiled tubing drilling robot; a power drill and a drill bit are fixedly connected to a downhole end of the coiled tubing drilling robot.

9. The coiled tubing drilling robot system according to claim 8, wherein a spring piece is arranged in the second supporting arm, an oblique block is fixedly arranged at a bottom of the spring piece, and a size of the oblique block is matched with a size of the groove.

10. The coiled tubing drilling robot system according to claim 9, wherein an arc-shaped surface A is formed on the oblique block, and an arc-shaped surface B is formed on each of the single oblique blocks.

11. The coiled tubing drilling robot system according to claim 8, wherein the control short section includes an upstream liquid inlet and a downstream liquid inlet; the upstream liquid inlet is connected to the first supporting cylinder and the first telescopic cylinder via pipelines, and the downstream liquid inlet is connected to the second telescopic cylinder and the second supporting cylinder via pipelines.

12. The coiled tubing drilling robot system according to claim 8, wherein a first pressure sensor, an upstream filter, a first two-position four-way electromagnetic reversing valve, a second pressure sensor and a first electric proportional relief valve are arranged on the pipeline between an upstream liquid inlet and the first supporting cylinder; the first two-position four-way electromagnetic reversing valve and the first electric proportional relief valve are connected to a downhole annulus via pipelines.

13. The coiled tubing drilling robot system according to claim 8, wherein a pressure sensor, a downstream filter, a two-position four-way electromagnetic reversing valve and an electric proportional relief valve are arranged on the pipeline between a downstream liquid inlet and the second supporting cylinder; the electric proportional relief valve and the two-position four-way electromagnetic reversing valve are connected to a downhole annulus via pipelines.

14. The coiled tubing drilling robot system according to claim 8, wherein the first telescopic cylinder has a differential connection pipeline, and a pressure sensor, a flow sensor, an electric proportional relief valve, an electric proportional throttle valve and a three-position four-way electromagnetic reversing valve are arranged on a connection pipeline between an upstream chamber and a downstream chamber of a piston of the first telescopic cylinder.

15. A process parameter control method for the coiled tubing drilling robot according to claim 1, comprising the following steps:

S1, making a coiled tubing intelligent drilling rig generate mud pressure pulse waves to turn on the coiled tubing drilling robot;

S2, making the coiled tubing drilling robot drive a drill string to drill;

S3, when the drill string drills, making a drill string vibration measurement device measure a vibration condition of the drill string in real time that indicates bit wear and rock drilling performance;

S4, making the coiled tubing drilling robot drive the drill string to drill at an optimal drilling speed and drilling pressure according to the vibration condition of the drill string measured by the drill string vibration measurement device; and S5, making the coiled tubing drilling rig generate mud pressure pulse waves to turn off the coiled tubing drilling.

16. The process parameter control method according to claim 15, wherein step S2 comprises the following steps:

S201: making the coiled tubing drilling robot determine a series of factors affecting drilling, wherein the factors comprise a depth of a formation where the drill string is located, rock drilling performances and bit wear; and S202, making the coiled tubing drilling robot calculate an appropriate drilling speed and drilling pressure according to the factors, and drive the drill string to drill.

17. The process parameter control method according to claim 15, wherein step S4 comprises the following steps:

S401, making the coiled tubing drilling robot calculate and analyze results of rock performances and degree of bit wear according to the vibration condition of the drill string measured by the drill string vibration measurement device; and S402: making the coiled tubing drilling robot calculate an appropriate drilling speed and drilling pressure according to results of the vibration condition of the drill string, and drive the drill string to drill forward; then making the drill string vibration measurement device feed-back the vibration condition of the drill string in real time and changing the drilling speed and a drilling pressure to the optimal drilling speed and drilling pressure based upon the results of the vibration condition of the drill string.

18. The process parameter control method according to claim 15, wherein, in step S5, the drilling robot is configured to be turned on and turned off by a ground control system; determining downhole working conditions according to the vibration condition of the drill string measured by the drill string vibration measurement device; turning off the drilling robot when a drilling system fails to change a drilling speed and a drilling pressure to the optimal drilling speed and drilling pressure based upon the results of the vibration condition of the drill string.

19. A coiled tubing drilling robot, comprising:

a first main body, a control short section and a second main body, wherein the first main body is located upstream of the second main body, and the control short section is located between the first main body and the second main body, and a drilling fluid flow path traverses through the first main body, the control short section and the second main body;

a first supporting cylinder, a first supporting arm and a first telescopic cylinder are arranged on the first main body, wherein the first supporting cylinder is located upstream of the first telescopic cylinder, and the first supporting arm is located between the first supporting cylinder and the first telescopic cylinder;

a second telescopic cylinder, a second supporting arm and a second supporting cylinder are arranged on the second main body, wherein the second supporting cylinder is located upstream of the second telescopic cylinder, and the second supporting arm is located between the second supporting cylinder and the second telescopic cylinder;

a piston rod arranged in each of the first supporting cylinder and the second supporting cylinder, wherein a single oblique block is fixedly arranged on each of the piston rods; each single oblique block is provided with a groove, and a spring piece is arranged in each of the first and the second supporting arms, an oblique block is fixedly arranged at a bottom of each of the spring pieces, and a size of the oblique block is matched with a size of the groove, and an arc-shaped surface A is formed on the oblique block, and an arc-shaped surface B is formed on each of the single oblique blocks.

* * * * *